US009970162B2

(12) United States Patent
Reindl et al.

(10) Patent No.: US 9,970,162 B2
(45) Date of Patent: May 15, 2018

(54) TEXTILE RUN AND USE THEREOF

(71) Applicant: Mr. Snow GmbH, Chemnitz (DE)

(72) Inventors: Jens Reindl, Chemnitz (DE); Arndt Schumann, Chemnitz (DE); Felix Neubert, Chemnitz (DE)

(73) Assignee: Mr. Snow GmbH, Chemnitz (DE)

( * ) Notice: Subject to any disclaimer, the term of this patent is extended or adjusted under 35 U.S.C. 154(b) by 0 days. days.

(21) Appl. No.: 15/142,369

(22) Filed: Apr. 29, 2016

(65) Prior Publication Data

US 2016/0289901 A1 Oct. 6, 2016

Related U.S. Application Data

(63) Continuation-in-part of application No. PCT/EP2014/073379, filed on Oct. 30, 2014.

(30) Foreign Application Priority Data

Oct. 30, 2013 (DE) ..... 10 2013 018 351
Jan. 22, 2014 (DE) ..... 10 2014 000 845

(51) Int. Cl.

| | |
|---|---|
| ***A63C 19/10*** | (2006.01) |
| ***E01C 13/12*** | (2006.01) |
| ***D03D 15/10*** | (2006.01) |
| ***D03D 27/06*** | (2006.01) |
| ***D03D 13/00*** | (2006.01) |
| *A63B 22/00* | (2006.01) |

(52) U.S. Cl.

CPC ..... *E01C 13/12* (2013.01); *A63C 19/10* (2013.01); *D03D 13/004* (2013.01); *D03D 15/10* (2013.01); *D03D 27/06* (2013.01); *A63C 2201/04* (2013.01); *A63C 2203/12* (2013.01); *D10B 2321/022* (2013.01); *D10B 2505/20* (2013.01)

(58) Field of Classification Search

CPC ..... A63C 10/00; A63C 19/00; A63C 19/02; A63C 19/10; A63C 2201/04; A63B 22/00; A63B 22/02; A63B 22/0235; A63B 22/0285

USPC ..... 472/88–92; 482/54

See application file for complete search history.

(56) References Cited

U.S. PATENT DOCUMENTS 3,202,266 A * 8/1965 Schmermund ..... A24B 7/14 131/108
4,423,864 A * 1/1984 Wiik ..... A63B 22/0012 434/253
5,964,634 A * 10/1999 Chang ..... A47C 13/005 446/111

FOREIGN PATENT DOCUMENTS

| | | |
|---|---|---|
| CN | 1932154 | 3/2007 |
| DE | 288982 | 11/1913 |
| DE | 1871540 U | 12/1962 |
| DE | 2318415 A | 10/1974 |

(Continued)

OTHER PUBLICATIONS

K. Reichert and W. Schlee, "das moderne Teppich Lexikon" (1989).
A. Kiessling, M. Matthes, "Textilfachwörterbuch" (1993).

*Primary Examiner* — Kien Nguyen
(74) *Attorney, Agent, or Firm* — 24IP Law Group; Timothy R DeWitt

(57) ABSTRACT

A textile run with a slide surface (1, 51) consisting of looped fabric, the looped fabric comprising loops (4, 54) which are formed of warp threads by weaving or of pile threads by tufting and have a height (3, 53) of between at least 3 mm and at most 10 mm, 100 to 950 loops being disposed over an area of 1 dm 2. The invention further concerns the use of the textile run.

12 Claims, 3 Drawing Sheets

(56) References Cited

FOREIGN PATENT DOCUMENTS

| | | | | |
|---|---|---|---|---|
| DE | 211137 | U1 | | 3/2003 |
| DE | 102005062711 | A | | 7/2007 |
| DE | 20201115370 | | * | 1/2011 |
| DE | 202011105370 | U1 | | 11/2011 |
| DE | 202012006509 | U1 | | 9/2012 |
| FR | 2772053 | A1 | | 6/1999 |
| GB | 2394902 | A | | 12/2004 |
| NL | 1016230 | C | | 6/2002 |
| WO | 2008151748 | A1 | | 12/2008 |

* cited by examiner

TEXTILE RUN AND USE THEREOF

CROSS-REFERENCE TO RELATED APPLICATIONS

This application is a continuation-in-part of International Patent Application No. PCT/EP2014/073379 filed on 30 Oct. 2014 and claiming priority of German Patent Applications Nos. DE 10 2013 018 351.0 filed on 31 Oct. 2013 and DE 10 2014 000845.2 filed on 22 Jan. 2014. The above-referenced applications hereby are incorporated in their entirety herein by reference

BACKGROUND OF THE INVENTION

Field of the Invention

The present invention relates to the field of artificial pistes or textile pistes for winter sports.

Brief Description of the Related Art

Artificial pistes are moving belts, flat support elements or mats, produced, for example from plastic elements and which are configured as gliding surfaces to be used by winter sports equipment, such as but not limited toskis or plastic toboggans. The artificial pistes have already been known for several decades. A wide range of systems exist which can replicate the properties of snow-covered ski pistes with a greater or lesser degree of success. These properties include, for example, the guidance of the winter sports equipment, the gliding behavior, the absorption of impacts and the risk of injury from the artificial pistes.

The flat support elements or mats are installed to enable movement on the flat support elements or mats using cross-country skis, Alpine skis, snowboards, ski jump skis and plastic toboggans, as well as snow tubes, on both level or inclined surfaces. In this context, a substrate onto which the artificial piste is laid can be natural soil, concrete, etc. or of framework supporting elements.

In addition, the artificial piste can also be used in the form of a continuous belt in moving belts. This circulating artificial piste can be traveled on using traditional cross-country skis, Alpine skis or snowboards.

In the present disclosure, the artificial piste is a textile piste and is formed from a woven fabric. This woven fabric is characterized by good glide and wear characteristics as well as by a grip similar to that of snow. The artificial piste can be used in the sports and recreational sector with sports equipment, such as but not limited to cross-country skis, Alpine skis, snowboards, ski jump skis and with toboggans and snow-gliding equipment.

The woven fabric has a surface and is formed from weft threads and warp threads. The warp threads are made of slippery as well as wear-resistant and cut-resistant plastic material, and by means of loops the warp threads form on the surface a kind of "knop structure", i.e. a structure with a number of protuberances. The sports equipment sinks into this surface. This results in a track being formed in the surface of the woven fabric and the sports equipment is thus guided. This enables turns can be executed using Alpine skis and snowboards in the same way as on snow. Because of the knop structure, even a leg push-off phase with a skating ski is perceived as being performed on snow.

The woven fabric can be additionally stabilized or fixed with a backing coating applied underneath the woven fabric. For use in a continuous belt, the woven fabric is applied to the surface of the continuous belt.

Large-surface downhill artificial pistes as well as cross-country ski tracks are composed of a plurality modules of the artificial pistes. These modules are affixed to the ground by means of straps and ground spikes. The modules are connected together by bonding, welding, sewing, hook-and-loop fasteners or zippers.

Artificial pistes for winter sports known in the art consist of injection molded plastic grid panels, for example. On approximately 2 cm wide ribs of the grid, plastic pins of the same height are disposed which are intended to function as a replacement for snow. Mats made up of slats onto which plastic rods are affixed are known for ski jump and tubing applications. Large surface mats of tufted or woven pile fabric (e.g. UK Patent Application No GB 2 394 902) are also known. In this case, the pile thread consists of synthetic monofilament yarns or film yarns. French Patent Application No. FR 2 772 053 describes an artificial piste or glide surface based upon a lattice-structured knitted fabric using monofilament yarns.

The German utility model No DE 20 2011 105 370 U1 describes a glide fabric, the glide surface of which is formed of pile loops or pile tufts. The pile loops consist of multifilament yarn or fiber yarn. These yarns are produced from man-made fibers.

The German patent application No DE 2318415 A teaches a cross-country track for the classic technique. The tracks are laid individually on the ground. As a glide surface, each track comprises plastic panels which are provided with scales to increase the static friction between ski and plastic panel during the leg push-off. The track guidance is accomplished by means of square sections attached laterally and open towards the top at an angle. Grooves are formed in the profiles for positively securing the plastic panels.

In the German patent application No DE 102005062711A1, a glide surface, which is formed from knops, is described. The glide surface is coated with fluoropolymers. In the wet test and when using lubricants, a friction coefficient of less than $\mu=0.06$ is attained with respect to the ski.

The German patent application DE 288982A5 teaches artificial ski tracks, in particular for ski jumps. The special modules described therein have air vents in order to create an air cushion for reducing friction between ski and substrate.

A base area made from plastic material with knops made of a ceramic material arranged thereon in a grid pattern is described in the German utility model DE 20211137 U1.

In the further development described in the international patent application WO 2008151748 A1, the protuberances can be exchanged. The material and the shape of the knops varies.

The German utility model DE 1871540 U describes a cross-country skiing track for training in the classic technique. The track consists of a synthetic profile and has grooves in the glide direction on the glide surface.

With all systems, irrigating the glide surface or treatment with lubricants reduces friction. The irrigation must occur permanently, however, since these systems have no water storage capability.

These artificial pistes have not been sufficiently adapted to practical requirements, and these deficiencies can be summarized as follows:

- the frictional resistance between the sports equipment and the surface is very high in all systems;
- the guiding characteristics of the sports equipment are inadequate;
- due to design and material factors, with most systems the risk of injury is high to very high;

the installation of the systems is sometimes extremely expensive;

in order to obtain reasonable gliding or sliding action, the majority of systems require permanent irrigation;

the prior art systems have no water storage capability.

SUMMARY OF THE INVENTION

In a preferred embodiment, the present invention is a textile run with a slide surface consisting of looped fabric, the looped fabric comprising loops which are formed of warp threads by weaving or of pile threads by tufting and have a height of between at least 3 mm and at most 10 mm, 100 to 950 loops being disposed over an area of 1 dm 2. The invention further concerns the use of the textile run.

In a preferred embodiment the present invention is a textile piste with a glide surface comprising a loop fabric, wherein the loop fabric comprises a plurality of loops formed of at least one of a plurality of warp threads by means of weaving or of pile threads by means of tufting, said loops having a height of between at least 3 mm and 10 mm, with 100 to 950 loops being arranged on an area of 1 $dm^2$, wherein the textile piste has a direction of travel and wherein the direction of travel and an orientation of the warp threads are parallel to each other. In one embodiment, in the weft direction, the loops are disposed adjacently in the weaving direction with a spacing of between 5 mm and 20 mm between two rows of loops. In another embodiment, in the weft direction, the loops are disposed adjacently in the weaving direction with a spacing of between 2 mm and 20 mm between two rows of loops. In yet another embodiment, in the weft direction, the loops (1, 4) have a spacing of 2 mm to 10 mm.

The warp threads or the pile threads are made from yarns selected from the group consisting of a monofilament, a monofilament yarn or thread formed from continuous filaments, or a monofilament braided fabric formed from continuous filaments, a spliced yarn, a ribbon yarn or a jacketed core structure with a jacket made of monofilaments. The yarn may be made of a polymer, for example, at least one of polypropylene, polyethylene, polyphenylene sulfie or polyamide. The warp threads may have a yarn count of 5,000 to 30,000 dtex.

The textile piste may further comprising connection elements for connection with another textile piste. The connection elements may be one of hook-and-loop fasteners or zip fasteners. The ends of the textile piste may be joined together to form a circulating belt.

Still other aspects, features, and advantages of the present invention are readily apparent from the following detailed description, simply by illustrating a preferable embodiments and implementations. The present invention is also capable of other and different embodiments and its several details can be modified in various obvious respects, all without departing from the spirit and scope of the present invention. Accordingly, the drawings and descriptions are to be regarded as illustrative in nature, and not as restrictive. Additional objects and advantages of the invention will be set forth in part in the description which follows and in part will be obvious from the description, or may be learned by practice of the invention.

BRIEF DESCRIPTION OF THE DRAWINGS

For a more complete understanding of the invention and the advantages thereof, reference is now made to the description and the following drawings, in which.

DETAILED DESCRIPTION OF THE INVENTION

The present specification discloses an artificial piste or glide surface, having characteristics similar to natural winter sports pistes and snow-covered pistes. The artificial piste is suitable to be used in conjunction with traditional winter sports equipment and the artificial piste can be produced cost-effectively and is easily installed.

Figure 1:
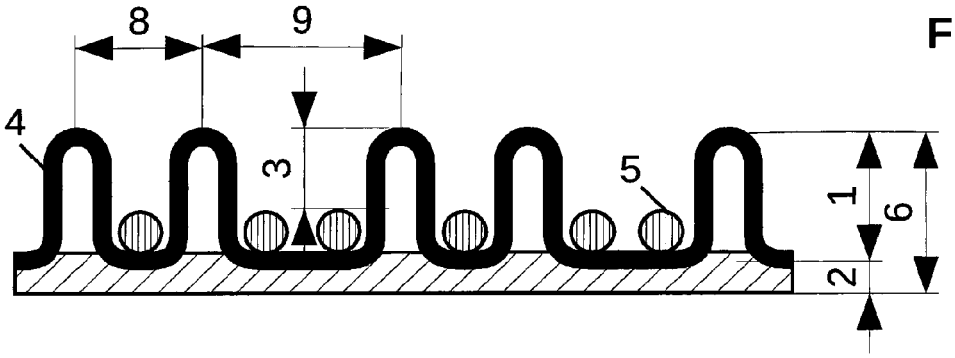
FIG. 1: shows a cross-section through a textile glide surface forming the artificial piste, wherein the cross-sectional plane extends plane-parallel to the warp threads.
Figure 2:
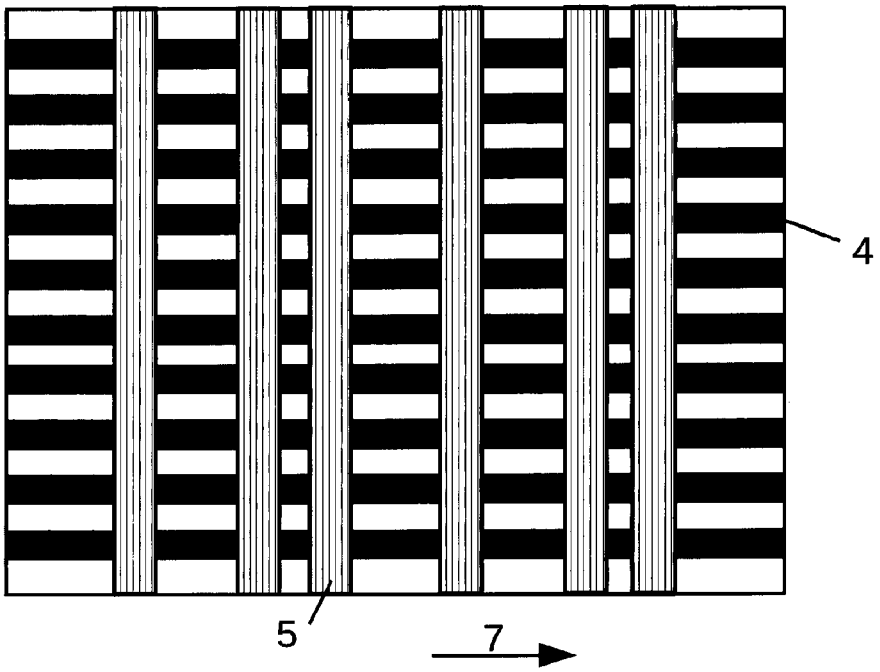
FIG. 2: shows a plan view onto the textile glide surface of the artificial piste.

The artificial piste is illustrated in FIGS. 1 and 2 and comprises a woven fabric 1 with warp threads 4, which form a glide surface, and a backing coating 2 under the warp threads. In one aspect, the woven fabric 1 is aligned such that the direction of travel 7 and orientation of the warp threads 4 correspond to each other, i.e. the direction of travel 7 is arranged parallel to the orientation of the warp threads 4. In this configuration, the following designs are providing characteristics similar to those of snow pistes.

The glide surface of the woven fabric 1 is constructed from warp threads, which are formed as loops 4. As a result, this achieves a type of knop structure, which enables the guidance of the sports equipment.

These loops 4 can be produced by weaving or also by tufting. At least one and a maximum of four weft threads 5 are disposed between the loop-forming warp threads in the weaving direction. These weft threads 5 lie above the warp threads 4. In the weft direction, the loops are arranged close together and have a height 3 of 3 mm and a maximum of 10 mm. Altogether, 100 to 950 loops are disposed on a surface of 1 $dm^2$.

The textile structure of the loop-forming warp threads 4 is a monofilament yarn or thread, formed from continuous filaments, or a monofilament braided fabric, formed from continuous filaments, or a spliced yarn or a ribbon yarn or a jacketed core structure with a jacket made of monofilaments. The spliced yarn and ribbon yarn is made of, for example, polyethylene or polypropylene. The monofilaments of the yarn or thread, of the braiding, and of the jacket of the jacketed core structure produced therefrom consist of polyester, polyethylene, polypropylene, polyphenylene sulfide or polyamide.

The underside of the woven fabric 1 is provided with a backing coating 2, in order to increase the stability and the wear protection. The backing coating 2 is made of, for example, styrene butadiene, latex, PVC or PUR.

For large areas, the artificial piste is composed of a plurality of modules. The modules are connected to each other by welding, bonding, sewing, hook-and-loop fasteners (see FIG. 3; FIG. 4) or zippers.

Example

The artificial piste of the exemplary embodiment is suitable for use in conjunction with Alpine skis, snowboards and cross-country skating skis and also with plastic toboggans and snow tubes, for example. The artificial piste is composed of the woven fabric 1, which forms the glide surface, and of a backing coating 2 under the woven fabric 1. The woven fabric 1, without the backing coating 2, has a base weight of 2.1 kg/m$^2$. The fabric 1, with the backing-coating 2, has a base weight of 3 kg/m$^2$. The woven fabric 1 is aligned such that the direction of travel 7 and the orientation of the warp threads 4 is parallel.

The glide surface of the woven fabric 1 is developed from warp threads, which are formed into loops 4. For this purpose, the warp threads consist of polypropylene spliced yarn with a yarn count of 24,000 dtex. By means of the loops, a kind of knop structure is obtained, which enables the guidance of the sports equipment. The loops 4 are arranged close together in the weft direction.

In the weaving direction, one and two weft threads 5 are alternately arranged between the loops 4. These weft threads 5 lie above the warp threads. In the weaving direction, the distance between the rows of loops is alternately 0.6 cm (FIG. 1, ref. No. 8) and 1.3 cm (FIG. 1; ref. No. 9). The height of the loops 3 is 6 mm. Thus, 210 loops are disposed on a 1 dm$^2$ surface.

To stabilize and to protect the woven fabric 1 against wear and tear, the back of the fabric 1 is coated with a reinforcing backing 2 comprising a 1 mm thick layer 2 of styrene-butadiene.

Figure 3:
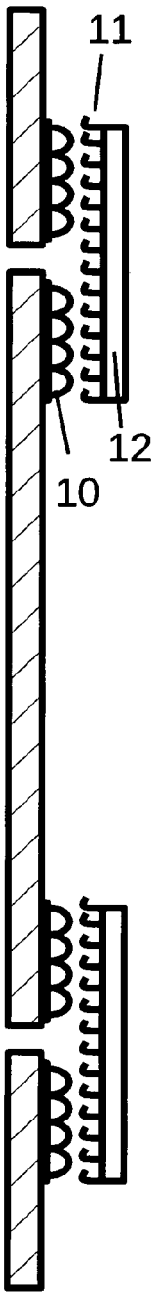
FIG. 3: shows a cross-sectional view of the module connection of the artificial piste by means of hook-and-loop tape.
Figure 4:
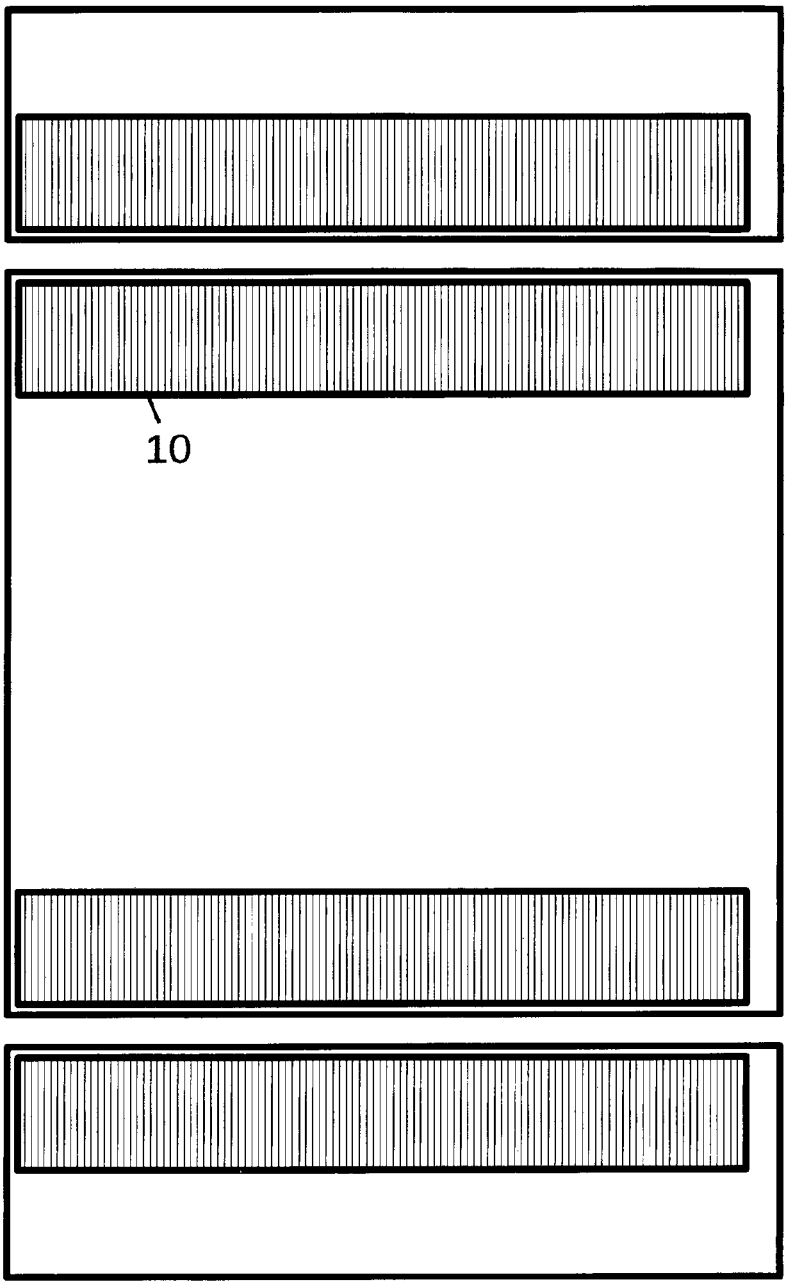
FIG. 4: shows the modules of the textile glide surface with loop tape for realizing a hook-and-loop connection; view from the rear.

The artificial pistes are made up of the plurality of modules (FIG. 3). The modules have a size of 2 m×10 m, for example. The lateral connection between the plurality of the modules is accomplished by means of hook-and-loop fasteners 10, 11. For this purpose, on the back of the modules, a loop tape 10 is sewn on along the entire length of the modules in the connection area. The loop tape 10 is 100 mm wide. The connection is accomplished in double shear using hook tape. The tape is 200 mm wide and overlaps the loop tape 10 of the glide surfaces to be connected over the length of 10 m.

Figure 5:
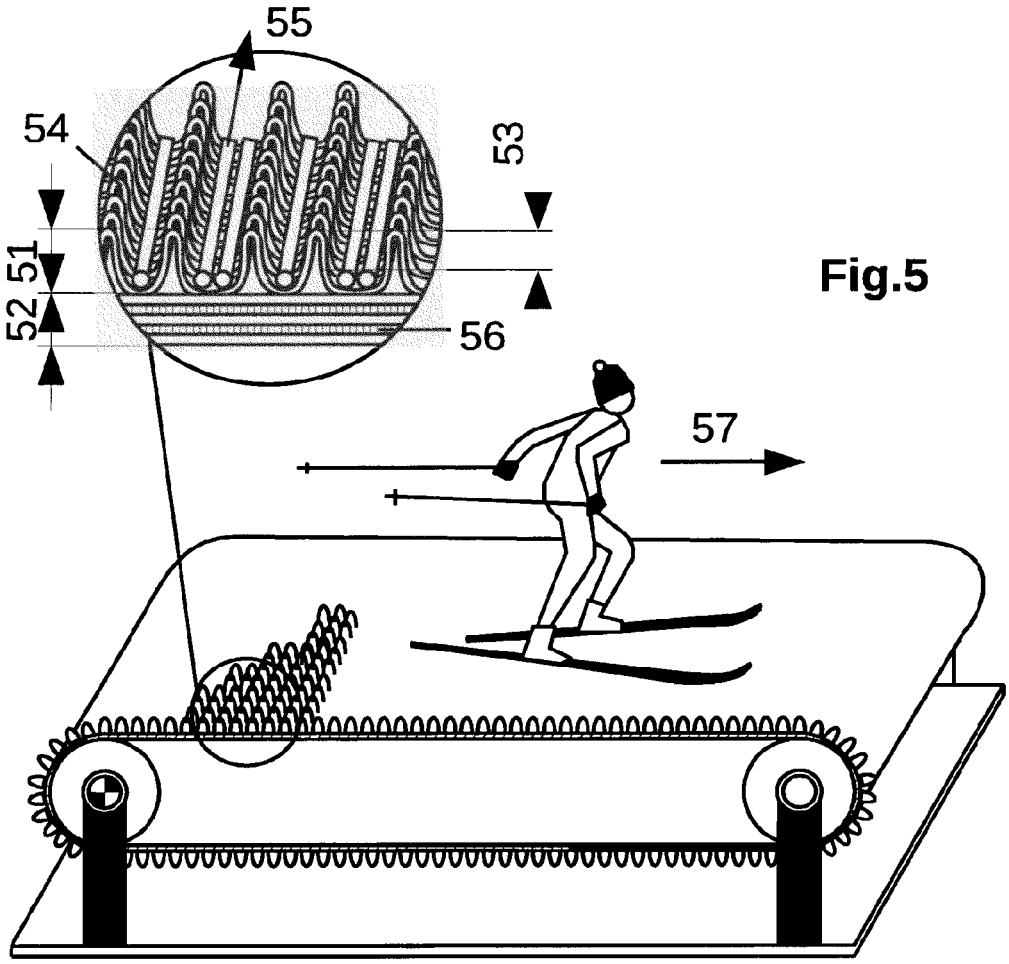
FIG. 5: Shows a moving belt with the textile glide area.

In another aspect of the invention, the woven fabric 51 is applied onto a circulating belt 52 (see FIG. 5). The circulating belt 52 is produced from polyvinyl chloride or polyurethane and can also be reinforced by armoring made of a polyester fabric 56. The circulating belt 52 is used in a treadmill ergometer. The woven fabric 51, without the circulating belt 52, has a base weight of 2 kg/m$^2$. The fabric 51 and the woven belt 52 together have a total base weight of 4.4 kg/m$^2$. The fabric 51 is aligned such that the direction of travel 57 and the orientation of the warp threads 54 correspond, i.e. in parallel.

The glide surface of the woven fabric 51 comprises warp threads, which are formed into loops 54. For this purpose, the warp threads comprise a polyester monofilament yarn with a yarn count of 20,000 dtex. By means of the loops 54, a kind of knop structure is obtained, which enables the guidance of the sports equipment. The loops 54 are arranged close together in the weft direction 55.

One and two weft threads 55 are disposed alternately between the loops 54. These weft threads 55 lie above the warp threads. In the weaving direction, the spacing of the rows of loops is alternately 0.6 cm and 1.3 cm. The height of the loops 53 is 6 mm. Thus, 210 loops are disposed on a 1 dm$^2$ surface.

The circulating belt 52 is 2.5 mm thick and is made of a polymer, such as polyvinyl chloride (PVC). For strengthening the circulating belt 52 and to absorb the tensile forces, the inside of the circulating belt 52 is reinforced by two layers of polyester fabric.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A textile piste with a glide surface arranged on a backing coating, the glide surface comprising a loop fabric, wherein the loop fabric comprises a plurality of loops formed of at least one of a plurality of warp threads by means of weaving or of pile threads by means of tufting, said loops having a height of between at least 3 mm and 10 mm, with 100 to 950 loops being arranged on an area of 1 dm$^2$, wherein the textile piste has a direction of travel and wherein the direction of travel and an orientation of the warp threads are parallel to each other, wherein, in the weft direction, the loops are disposed adjacently in the weaving direction with a spacing of between 5 mm and 20 mm between two rows of loops.

2. The textile piste according to claim 1, wherein, in the weft direction, the loops are disposed adjacently in the weaving direction with a spacing of between 2 mm and 20 mm between two rows of loops.

3. The textile piste according to claim 1, wherein, in the weft direction, the loops have a spacing of 2 mm to 10 mm.

4. The textile piste according to claim 1, wherein the warp threads or the pile threads are made from yarns selected from the group consisting of a monofilament, a monofilament yarn or thread formed from continuous filaments, or a monofilament braided fabric formed from continuous filaments, a spliced yarn, a ribbon yarn or a jacketed core structure with a jacket made of monofilaments.

5. The textile piste according to claim 4, wherein the yarn is made of a polymer.

6. The textile piste according to claim 4, wherein the yarn is made from at least one of polypropylene, polyethylene, polyphenylene sulfie or polyamide.

7. The textile piste according to claim 1, wherein the warp threads have a yarn count of 5,000 to 30,000 dtex.

8. The textile piste according to claim 1, further comprising connection elements for connection with another textile piste.

9. The textile piste according to claim 8, wherein the connection elements are one of hook-and-loop fasteners or zip fasteners.

10. The textile piste of claim 1, wherein ends of the textile piste are joined together to form a circulating belt.

11. A textile piste comprising:

a glide surface, the glide surface comprising a loop fabric, wherein the loop fabric comprises a plurality of loops formed of at least one of a plurality of warp threads by means of weaving or of pile threads by means of tufting, said loops having a height of between at least 3 mm and 10 mm, with 100 to 950 loops being arranged on an area of 1 dm$^2$, wherein the textile piste has a direction of travel and wherein the direction of travel and an orientation of the warp threads are parallel to each other; and a backing coating on a back side of said loop fabric, and wherein, in the weft direction, the loops are disposed adjacently in the weaving direction with a spacing of between 5 mm and 20 mm between two rows of loops.

12. The textile piste of claim 11, wherein the backing coating comprises at least one of styrene butadiene, latex, PVC and PUR.

* * * * *